US005980337A

United States Patent [19]

Little

[11] Patent Number: 5,980,337

[45] Date of Patent: Nov. 9, 1999

[54] IDC SOCKET CONTACT WITH HIGH RETENTION FORCE

[75] Inventor: Phillip V. Little, Hazlemere High Wycombe, United Kingdom

[73] Assignee: Thomas & Betts International, Inc., Sparks, Nev.

[21] Appl. No.: 09/100,604

[22] Filed: Jun. 19, 1998

[51] Int. Cl.[6] ..... H01R 11/22

[52] U.S. Cl. ..... 439/857; 439/886

[58] Field of Search ..... 439/857, 851, 439/856, 842, 886

[56] References Cited

U.S. PATENT DOCUMENTS

| | | | |
|---|---|---|---|
| 3,867,008 | 2/1975 | Gartland, Jr. . | |
| 4,140,361 | 2/1979 | Sochor . | |
| 4,241,970 | 12/1980 | Rider, Jr. et al. . | |
| 4,598,972 | 7/1986 | Mullen, III et al. . | |
| 4,607,907 | 8/1986 | Bogursky | 439/886 |
| 4,874,338 | 10/1989 | Bakermans . | |
| 4,918,813 | 4/1990 | Mori et al. | 439/857 |
| 5,252,097 | 10/1993 | Lindeberg et al. | 439/857 |
| 5,518,426 | 5/1996 | Plainer . | |
| 5,681,190 | 10/1997 | Childs . | |
| 5,730,606 | 3/1998 | Sinclair . | |

*Primary Examiner*—Michael L. Gellner
*Assistant Examiner*—Antoine Ngandjui
*Attorney, Agent, or Firm*—Hoffmann & Baron, LLP

[57] ABSTRACT

An improved electrical terminal having a tri-beam construction is adapted to be received in an electrical connector housing and includes two retention beams which provide high normal retention forces to a conventional male pin contact slidably disposed therebetween. A third beam is disposed substantially parallel to the two retention beams and constitutes a contact beam which provides a standard normal force and a contact surface which is selectively gold plated on a contact interface region defined thereon. The contact interface region defines an area in which the male pin contact and the electrical terminal establish an electrical connection. The connector beam is offset from the retention beams so as to define a space in which the male pin contact is retained.

4 Claims, 6 Drawing Sheets

IDC SOCKET CONTACT WITH HIGH RETENTION FORCE

FIELD OF THE INVENTION

This invention relates to an electrical terminal adapted to be inserted into a connector housing. More particularly, the present invention is directed to a female terminal having a tri-beam construction, wherein two of the beams provide high retention force and the third beam provides a standard normal force contact.

BACKGROUND OF THE INVENTION

Electrical contacts and terminals have long been used to terminate and connect a variety of pins which carry electrical power or signals. A number of electrical terminal configurations are known and used in the art, including sockets, spring-like tines and flexible spring-arms. The present invention is directed to electrical terminals of a "tuning fork" configuration, which are generally known in the art.

Certain tuning fork configurations have been developed for use in various connector structures. In applications subject to high vibration or shock forces, a terminal with high retention forces is required to prevent detachment of a mating contact during operation. The tuning fork design is advantageous because the outward deflection of a pair of retention beams upon insertion of a mating pin contact creates a good contact force between the terminal and the inserted contact pin. However, electrical terminals of the tuning fork type configuration are not without certain disadvantages. A male contact pin which is retained by the fork design may have rough connection surfaces due to shearing during die stamping of the pin. The contact faces of the two retention beams of the tuning fork terminal likewise are sheared edges of material produced during a stamping operation and therefore have a comparatively rough surface finish. The interface between these rough surfaces creates a poor electrical contact between the pin and the terminal and an increased possibility of damage to the terminal and the contact during repeated mating cycles.

There have been numerous attempts to overcome the problems inherent in conventional tuning fork designs. For example, a terminal shown in U.S. Pat. No. 4,140,361 has a receptacle having a pair of opposing cantilever legs with a resilient cantilever leg centered therebetween. The center leg makes connection with one side of a mating pin while the other two legs contact the other side of the mating pin. The two opposing legs will deflect outwardly upon insertion of a pin therebetween, thus assuring satisfactory contact forces are being applied so as retain such pin. The opposing legs and the center leg are offset from a cable engaging portion, significantly adding to the space occupied by the terminal. None of the legs which receive a mating pin is coated with a conductive material which would facilitate electrical connection between the terminal and the pin.

A similar prior art design is shown in U.S. Pat. No. 4,598,972. This type of terminal is referred to as a "clip-on lead". A clip-on lead has an elongated shaft suitable for electrical connection, the upper end of which widens into a pair of fork-like bracing members. A front spring member protrudes normal to the bracing members and curves into a plane which is parallel to that of the bracing members. Both the rear bracing members and the front spring member are soldered to a substrate received therebetween. As a result, the lead is much harder to separate from the substrate, a characteristic that is highly desirable in high shock/high vibration environments. However, the protrusion of the elongated shaft from a rear surface of the substrate significantly increases the electrical length from the substrate to a PC board, adversely affecting the performance of a high frequency circuit.

A problem inherent in the above described configurations is that the high normal force exerted by the beams can also damage the contact area, leading to premature failure of the connector system. Additionally, if the contact surfaces of the forks are plated or otherwise covered in a conductive material such as gold, the combination of high retention forces and rough material edges causes damage to the covering, resulting in lower operational life and correspondingly higher production and maintenance costs.

An alternative tuning fork terminal configuration is disclosed in U.S. Pat. No. 5,252,097. This patent provides for a female electrical terminal having a pair of flexible beams constituting a contact member and extending in a plane which is substantially perpendicular to the flexible beams. The contacting surfaces of each flexible beam has a coating layer of gold or tin. The deflection of the contact beams in this configuration is predetermined before assembly, thereby enabling high contact precision after assembly. The deflection of the flexible beams is limited by the guiding beam and is independent of the introduction of a conventional male pin contact. In use, the high and constant contact pressure protects against corrosion of the contact areas and provides integrity of a transmitted signal in cases of vibration or impact. However, this connector, like the other connector designs, makes it very difficult to deposit gold selectively onto the contact area. This means the entire ends of the beams must be immersion plated, a process which results in high gold consumption and correspondingly high manufacturing costs.

Therefore, it is desirable to provide an electrical terminal that provides a high retention force without reducing the operating life of the terminal.

SUMMARY OF THE INVENTION

It is therefore an object of the present invention to provide an improved electrical terminal for accommodating a contact pin.

It is another object of the present invention to provide an electrical terminal which maintains high retention forces during operations which produce high vibration and shock forces.

It is still another object of the present invention to provide an electrical terminal which prevents damage to the pin contact which is engaged by the terminal.

It is a further object of the invention to provide an electrical terminal with a tri-beam construction wherein two of the beams provide necessary high retention forces and the third beam provides a standard normal force contact.

It is still a further object of the invention to provide an electrical terminal with a tri-beam construction in which a contact beam can be selectively gold plated.

In the efficient attainment of these and other objectives, the present invention provides a female electrical terminal having a tri-beam construction in which two retention beams provide high normal retention forces to a conventional male pin contact slidably disposed therebetween. The third beam provides a standard normal force and is selectively gold plated on a contact interface region defined thereon. The contact interface region defines an area in which the male pin contact and the terminal establish an electrical connection. The connector beam is offset from the retention beams so as to define a space in which the male pin contact is retained.

DETAILED DESCRIPTION OF THE PREFERRED EMBODIMENT

An electrical terminal is provided of generally the "tuning fork" type having a tri-beam construction wherein two beams provide necessary retention forces for securement of a mating pin contact of an electrical conductor and a third beam provides a standard normal force contact. The third beam is selectively coated with a conductive material such as gold and is offset from two opposed, substantially parallel retention beams. The third beam assumes electrical continuity between the terminal and the mating pin. The three beams are connected to one another in a body region of the terminal which extends into a coplanar engaging region. The engaging region defines prongs for securement of the terminal to a terminal housing. The body has opposing side surfaces, each or both of which may have a protrusion perpendicularly defined thereon. The protrusions are substantially sized and shaped to be retained within a corresponding female recess within a terminal housing. The protrusions act as locking tabs for further securement of the terminal during applications in which the terminal is subject to high vibration or shock forces.

Figure 1:
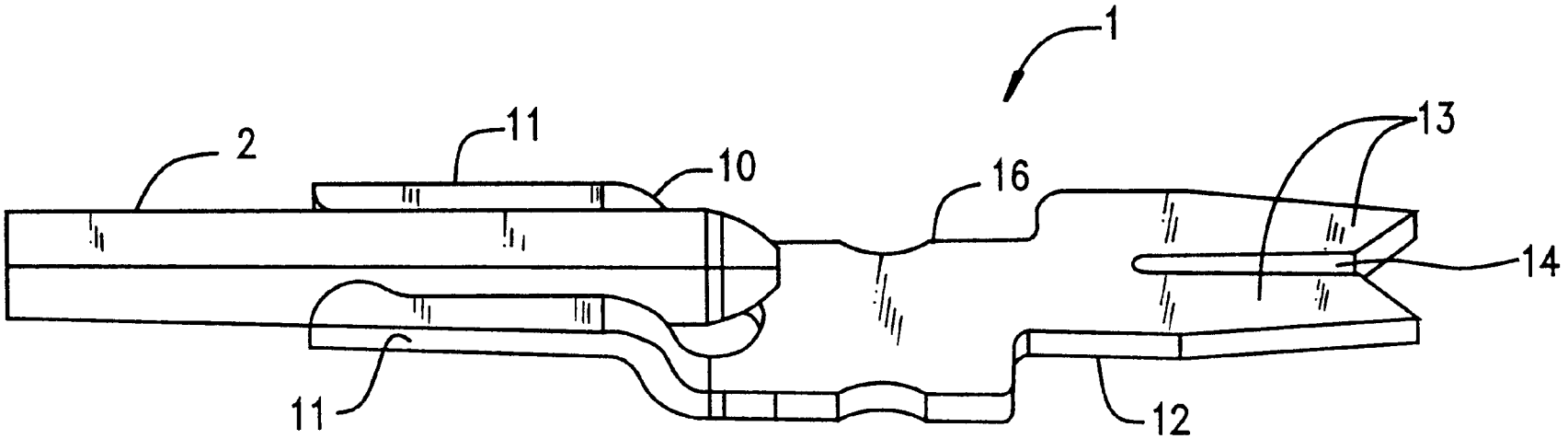
(PRIOR ART) FIG. 1
FIG. 1 shows a top perspective view of a contact interconnection system comprising an electrical terminal of the prior art and a conventional male pin contact.

Referring to FIG. 1, an elongate conventional tuning fork terminal 1 is shown accommodating a conventional male mating pin contact 2. Terminal 1 includes a receptacle end portion 10 for receiving pin 2, an insulation displacement contact (IDC) portion 12 for engaging a conductor of a multiconductor cable and a connector body 16 therebetween. Receptacle portion 10 defines a pair of retention beams 11 which are spaced apart from one another so as to define a free entry area for securingly engaging male pin contact 2 therebetween. Each beam 11 exerts a high retention force upon mating pin 2 in order to maintain a satisfactory electrical connection.

Figure 1A:
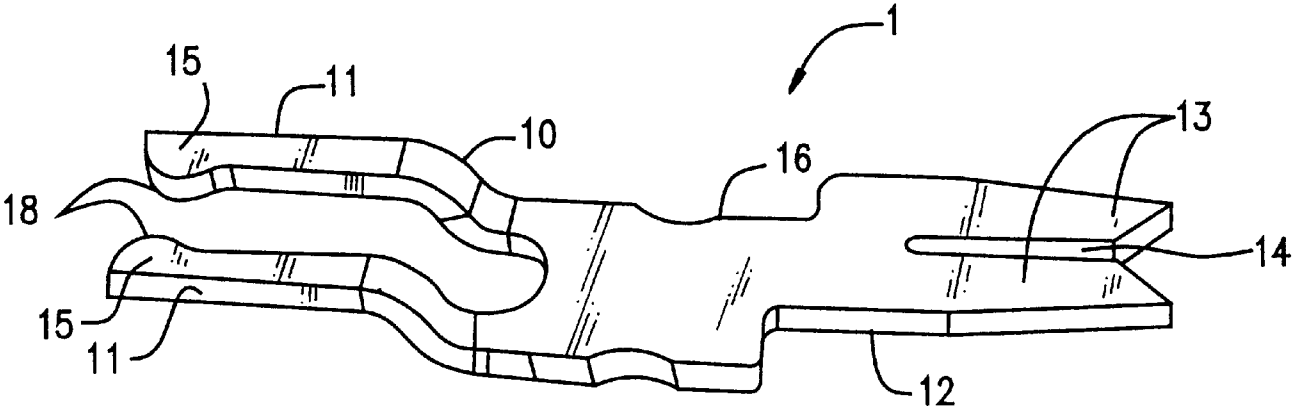
(PRIOR ART) FIG. 1A
FIG. 1A shows a top perspective view of the electrical terminal shown in FIG. 1.

As further depicted in FIG. 1A, each retention beam 11 has a tine 15 inwardly directed toward the other, opposing beam. Each tine 15 protrudes perpendicularly from an inner surface of a retention beam 11 and is defined at an extremity thereof. Each tine 15 further includes a contact area 18 on a side of the tine which faces an opposing beam 11 in a parallel configuration. Each contact area 18 defines a region in which the terminal establishes an electrical contact with mating pin 2. The contact areas are each coated with a conductive material, such as gold, to facilitate successful electrical contact between the terminal and the conductor.

As can be appreciated, coating of the contact areas 18 is difficult and expensive. The design of the contact beams makes it very difficult to selectively deposit gold onto each contact area. This means the entire ends of the retention beams have to be immersion plated, resulting in high gold consumption and correspondingly high production costs. Further, the design of the tuning fork terminal promotes exertion of high retention forces by the retention beams 11, thereby promoting damage of the gold-plated finishes in the contact areas. Such accelerated damage to the electrical contacting areas leads to premature failure of the connector system, resulting in higher operation and maintenance costs.

Figure 1B:
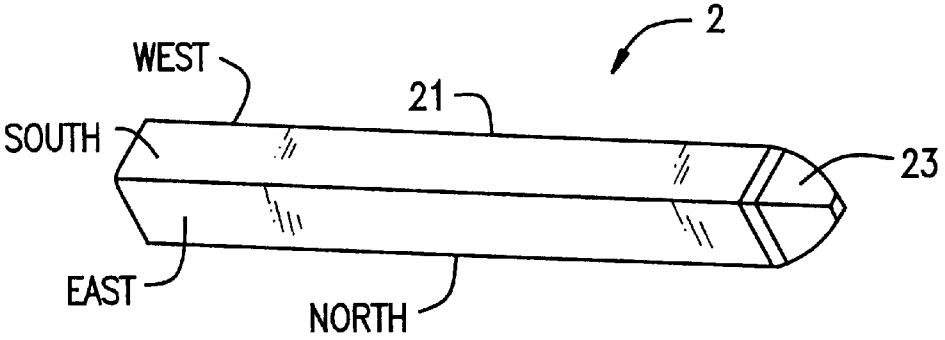
FIG. 1B shows a perspective view of the conventional male pin connector shown in FIG. 1.

Mating pin 2 shown in FIG. 1 and further depicted in FIG. 1B is a typical square section male pin contact having four faces labeled north, south, east and west. Pin 2 has a substantially obelisk configuration wherein a generally elongated square section body 21 tapers into a pointed head portion 23. Often, a mating pin of the type shown is fabricated from square section wire, which results in the four faces being smooth. However, in certain applications, the pins are stamped from a strip of correct thickness, in which case the east and west faces are rough due to shearing in a die during a stamping process. In this case, only the north and south faces are smooth.

IDC portion 12 defined at the opposite end of terminal 1 may be of the conventional blade type insulation displacement construction. Such configuration allows insulation displacing electrical connection to an insulated conductor. While an IDC portion 12 as an example is shown, any contact terminal end may be employed.

In a typical tuning fork design, high retention forces are achieved by providing two stiff retention beams 11 which exert a high normal force on the mating pin contact. The beams make contact with the east and west faces of mating pin 2, which can have a rough surface as described above. Further, the contact faces of the retention beams are sheared edges of material produced during a stamping operation. Thus, they too have a comparatively rough surface finish which increases the likelihood of poor electrical contact and increased possibility of pin damage during operation.

Now referring to FIGS. 2, 2A, 3 and 4, an electrical terminal of the present invention will now be described.

A female tri-beam terminal 100 is an elongated substantially planar member having a retention region 102 at one end, an IDC portion 104 at the other end and a body portion 106 therebetween. IDC portion 104 and connector body 106 are substantially coplanar with respect to each other and both are parallel to a plane in which retention region 102 is defined.

Retention region 102 defines a tri-beam construction wherein retention beams 111 provide a high retention force for removably engaging a mating pin 200, and contact beam 115 provides a standard normal force and a contact interface area for establishing and maintaining electrical contact between mating pin 200 and terminal 10. Mating pin 200 is a conventional square section male pin contact of the type previously described and illustrated in FIG. 1(*b*).

Two retention beams 111 and a contact beam 115 are connected together on terminal 100 at the interface of retention region 102 and connector body 106. Connector body 106 is substantially coplanar with IDC portion 104 and has two side surfaces 120. Either one or both of surfaces 120 may have a retention barb 131 protruding perpendicularly therefrom for removably securing terminal 100 to a terminal housing. Each retention barb 131 is shown having, in section, the shape of a rectangular tab, sized and shaped so as to engagingly fit within a corresponding female socket in the terminal housing. Thereby, the terminal can be locked in operational position so as to prevent detachment of the terminal from the terminal housing during operation of the contact interconnection system.

The pair of retention beams 111 extends from connector body 106 so as to be coplanar with both connector body 106 and engagement region 104. Beams 111 comprise a "tuning fork" configuration wherein the beams oppose one another in a coplanar, parallel orientation. Beams 111 are stiff longitudinal members which are offset from the connector body 106 by a ramped portion 140. The slope of ramped portion 140 determines the parameters of a spacing inherently defined between the retention beams and the contact beam, in which a corresponding mating pin 200 is slidably engaged. Beams 111 apply an elevated normal retention force to the east and west faces of mating pin 200 so as to removably secure the pin therebetween.

Figure 2:
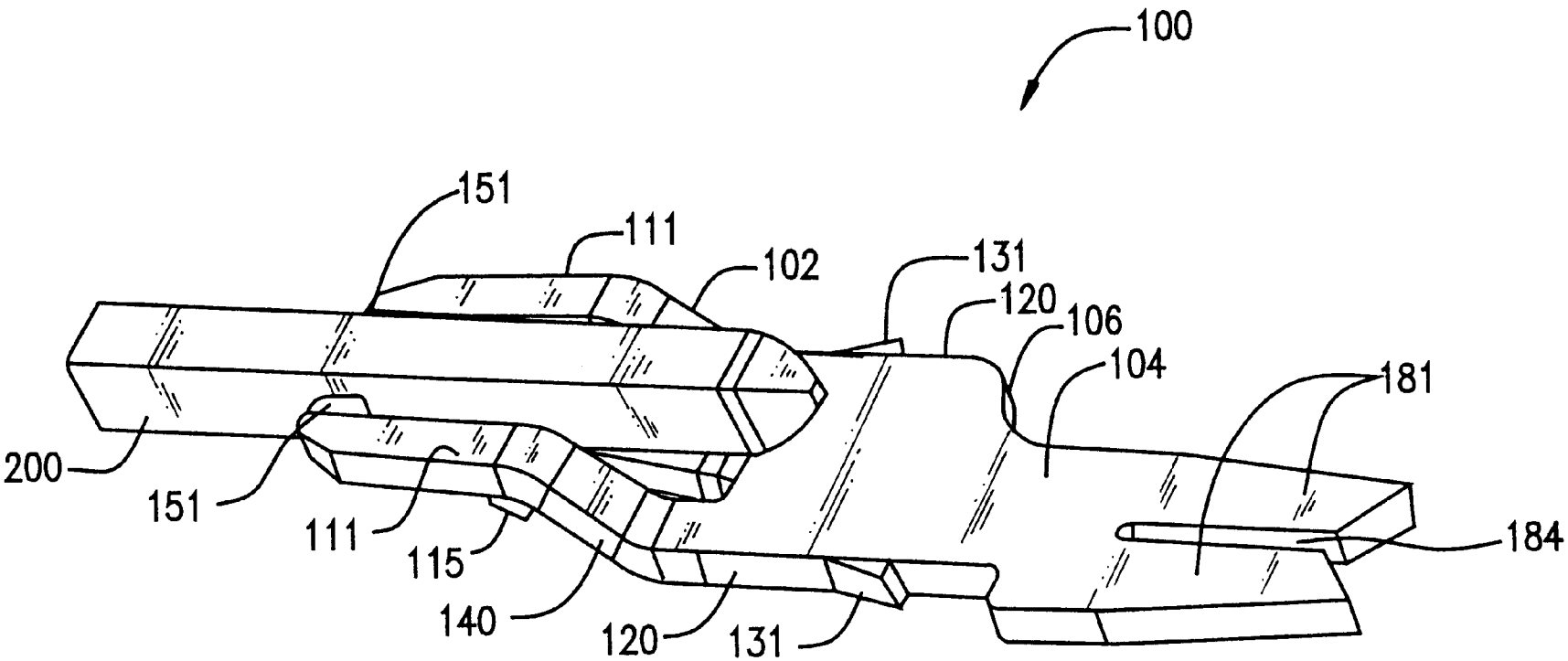
FIG. 2 shows a top perspective view of a contact interconnection system comprising an electrical terminal of the present invention and a conventional male pin contact.
Figure 2A:
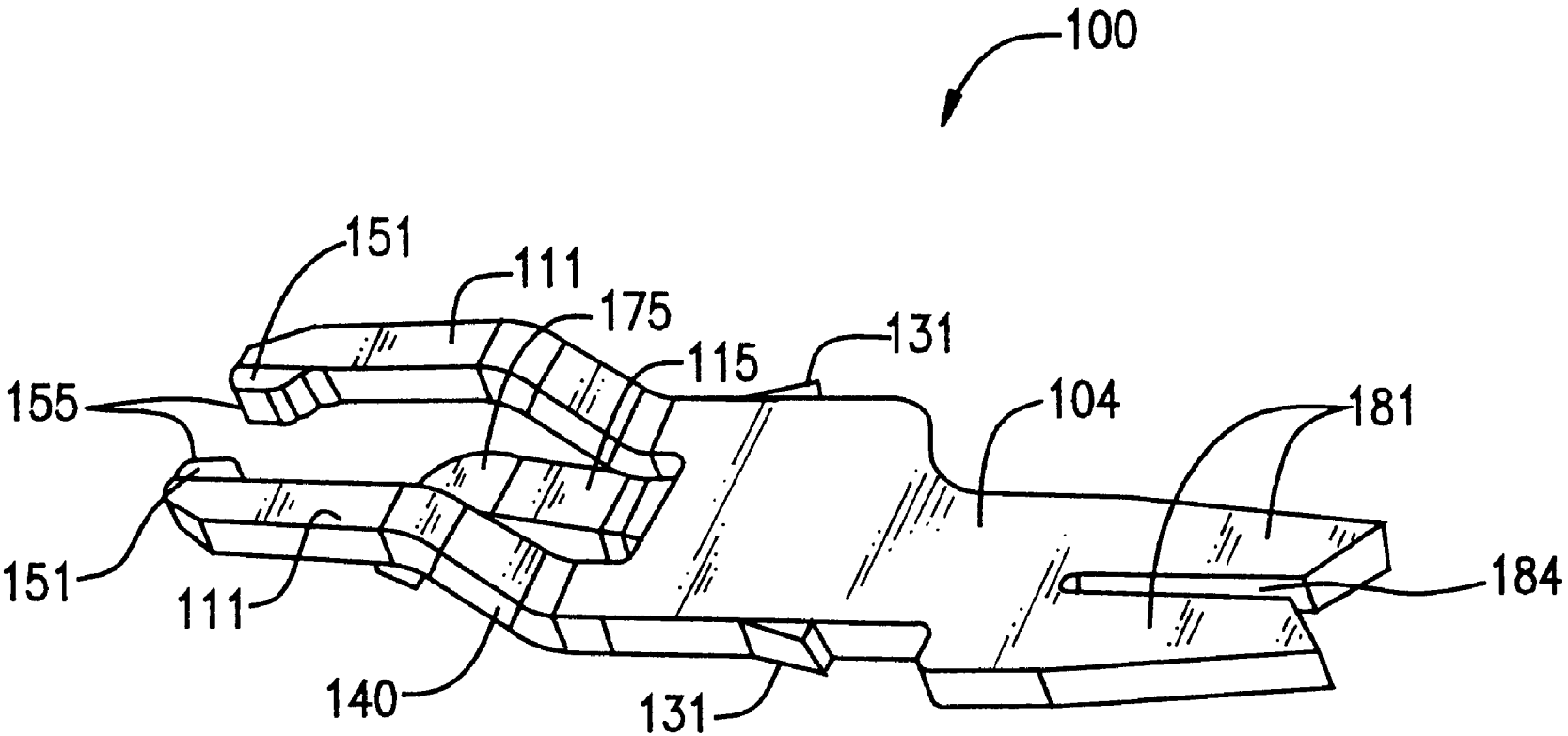
FIG. 2A shows a top perspective view of the electrical terminal of FIG. 2.

As shown in FIG. 2A, each retention beam 111 comprises an elongated longitudinal member having an unconstrained extremity upon which a tine 151 is defined. Each tine 151 protrudes perpendicularly from an inner surface of each retention beam and extends inwardly toward an opposing inner surface. Tines 151 each include a contact interface area 155 wherein the beams mechanically engage mating pin 200. Each contact interface area is parallel to an inner surface of a retention beam upon which it is defined and faces inwardly in the direction of an opposing contact interface area. Contact interface areas 155 are of sufficient size and shape to establish a successful electrical connection between terminal 100 and a male mating pin connector 200. Unlike the prior art tuning fork designs, neither retention beams 111 nor the tines 151 are gold-plated.

Figure 3:
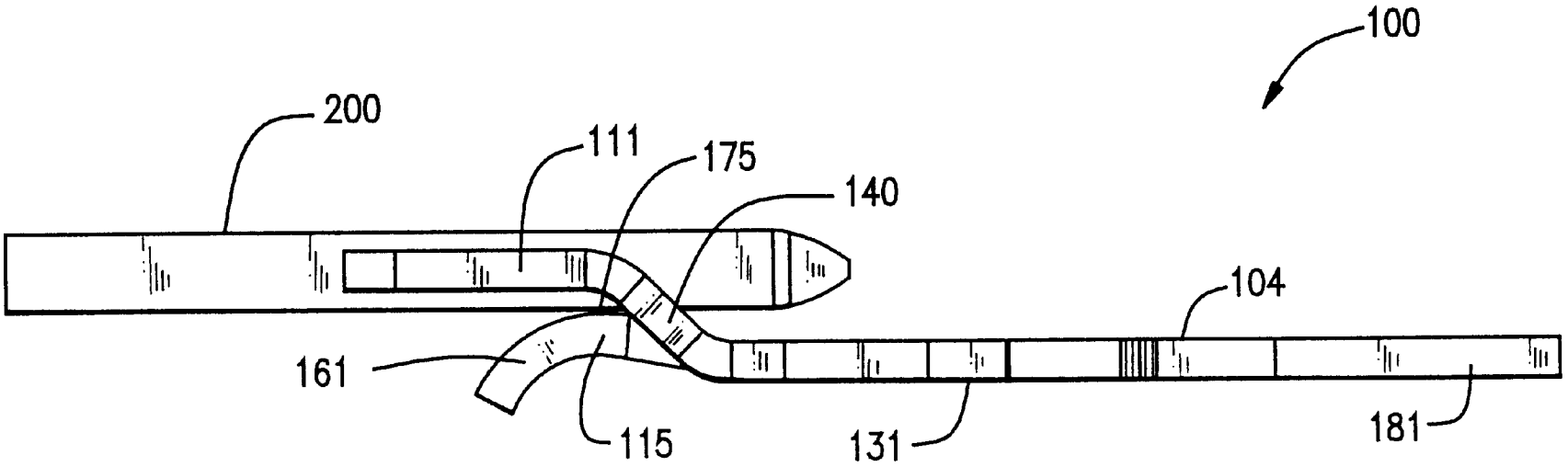
FIG. 3 shows a side view of the connector system of FIG. 2.
Figure 4:
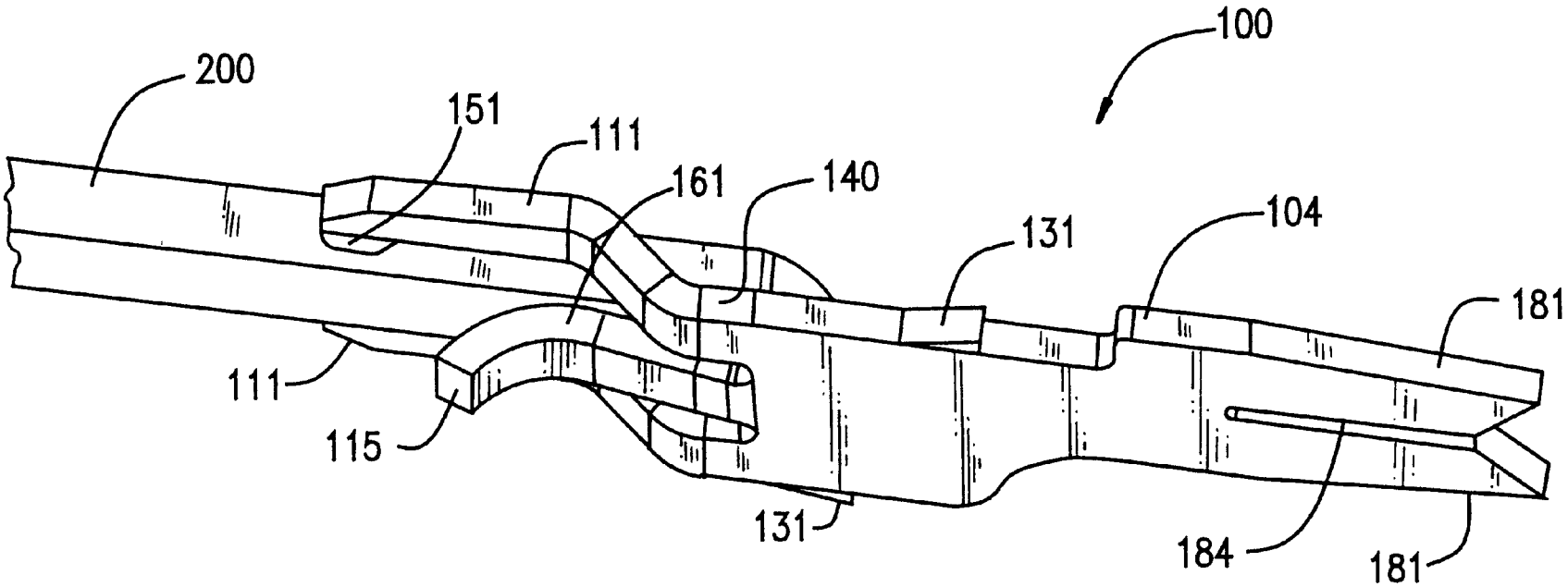
FIG. 4 shows a bottom perspective view of the connector system of FIG. 2.

As more easily seen in FIGS. 3 and 4, a contact beam 115 is provided which connects to retention beams 111 at the interface of retention region 102 and connector body 106. Beam 115 is of substantially shorter length than the retention beams and spans the space between retention beams 111. Beam 115 extends along the lengths of retention beams 111 to terminate in a curved shoulder 161. Beam 115 extends outward from connector body 106 so as to remain generally coplanar therewith and like connector body 106 and yet offset from a plane in which retention beams 111 are defined. The placement of beams 111 and 115 creates a free entry opening into which a correspondingly sized male mating pin 200 is slidably engaged.

Referring again to FIG. 2A, contact beam 115 includes a contact interface area 175 which is plated with a conductive material such as gold. The contact interface area defines a region wherein terminal 100 and male pin contact 200 are in electrical contact with one another. Contact between terminal 100 and contact 200 occurs on the north face of contact 200, which is a smooth surface. Establishment of an interface on the smooth north face of contact 200 eliminates damage to the gold plating, thereby prolonging the operational life of the connector system.

IDC portion 104 of terminal 100 provides a well-known slotted blade configuration for engaging an insulated conductor in insulation displacing fashion. Longitudinal prongs 181 extend outward from connector body 106 and define an engagement slot 184 therebetween which is sized and shaped to frictionally engage a conductor therein. Prongs 181 are generally coplanar with both connector body 106 and contact beam 115 of terminal 100 and substantially parallel to a plane in which retention beams 111 are defined as mentioned.

Terminal 100 is formed in a stamping process in which a stamped blank is provided having a contact portion, two retention portions, a connective plate and a dual prong-like conductor portion. The terminal is shaped by bending a blank of stamped metal (not shown) along predetermined bending lines using upper and lower dies. In the present invention, the terminal as stamped shows the retention beams being formed in a flat position and the contact beam formed at the same time. Immediately prior to the assembly of the connector system, the retention beams are formed into their operating position (as clearly seen in FIGS. 2 and 2(A)). This forming operation can be carried out on the assembly machine at no extra cost.

In this configuration, contact beam 115 is totally independent of retention beams 111 and is therefore designed to apply exactly the optimum contact normal force to establish a reliable electrical interface. Furthermore, this design allows selective plating of contact beam 115, minimizing gold usage and associated production costs.

Thus, the present invention provides an electrical terminal configuration having a tri-beam assembly in which two of the beams are primarily provided for retention of an electrical contact pin and the third beam is primely provided for electrical contact between the pin and the terminal. The configuration can be formed at a substantially lower cost than conventional tuning fork designs while prolonging the life of the connector system.

Various changes to the foregoing described and shown structures would now be evident to those skilled in the art. Accordingly, the particularly disclosed scope of the invention is set forth in the following claims.

What is claimed is:

1. An electrical terminal for terminating a mating pin contact comprising:

an elongate contact member having a termination end for extended electrical connection and an opposed retention end for mating connection to said mating pin contact;

said retention end having a tri-beam configuration including a pair of opposed retention beams and an intermediate contact beam;

said retention beams being unplated and defining therebetween a contact interface region for accommodating in mechanical securement said mating pin terminal; and said intermediate contact beam being at least partially conductively plated and positioned to electrically engage said mating pin contact.

2. An electrical terminal of claim 1 wherein each of said retention beams is disposed generally parallel to said intermediate contact beam and wherein said contact interface region includes each said retention beam having a protrusion which extends generally perpendicularly to a plane in which said retention beams are defined.

3. An electrical terminal of claim 1 wherein said intermediate contact beam is generally concavely shaped, having a curved shoulder defining, with said retention beams, an entry opening of said terminal.

4. An electrical terminal of claim 1 wherein said planar contact member has on a side surface at least one retention barb for connecting said terminal in a corresponding terminal housing.

* * * * *